US006400322B2

(12) United States Patent
Fang et al.

(10) Patent No.: US 6,400,322 B2
(45) Date of Patent: Jun. 4, 2002

(54) MICROSTRIP ANTENNA

(75) Inventors: Shyh-Tirng Fang, Tainan; Kin-Lu Wong, Kaohsiung, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/788,149

(22) Filed: Feb. 16, 2001

(51) Int. Cl.[7] ..... H01Q 1/38
(52) U.S. Cl. ..... 343/700 MS; 343/770
(58) Field of Search ..... 343/700 MS, 767, 343/770, 829, 846; H01Q 1/38

(56) References Cited

U.S. PATENT DOCUMENTS

| | | | | |
|---|---|---|---|---|
| 4,803,494 A | * | 2/1989 | Norris et al. | 343/770 |
| 4,958,386 A | * | 9/1990 | Louis-Jeune | 2/227 |
| 5,006,857 A | * | 4/1991 | DeHart | 343/700 MS |
| 5,229,777 A | * | 7/1993 | Doyle | 343/700 MS |
| 5,453,752 A | | 9/1995 | Wang et al. | 343/700 MS |
| 5,680,144 A | | 10/1997 | Sanad | 343/700 MS |
| 5,945,951 A | * | 8/1999 | Monte et al. | 343/700 MS |
| 6,091,364 A | * | 7/2000 | Murakami et al. | 343/700 MS |

FOREIGN PATENT DOCUMENTS

| | | |
|---|---|---|
| TW | 87101982 | 2/1998 |
| WO | WO 93/11582 | 4/1992 |

* cited by examiner

*Primary Examiner*—Tho G. Phan
(74) *Attorney, Agent, or Firm*—Darby & Darby

(57) ABSTRACT

A miniaturized microstrip antenna with variable broadband operation comprised of a ground patch, an isosceles-triangular patch with a base side, two isosceles sides, a top angle opposite the base side and two base angles. A pair of primary slots extending from the top angle sides toward the base angles are embedded in the isosceles-triangular patch. At least one pair of secondary slots extended from each primary slot. A substrate is located between the ground patch and the isosceles-triangular patch. The primary slots are approximately parallel to the sides of the isosceles-triangular patch. The second and the third slots branching from the primary slots are approximately perpendicular to the base side of the isosceles-triangular shaped patch. It is found that by selecting a proper dimension, the good broadband operation can be obtained. Lastly, inclusion of the slots and adjustment of the size of the slots on the microstrip antenna allows for a reduction in overall size and area of the microstrip antenna.

11 Claims, 4 Drawing Sheets

MICROSTRIP ANTENNA

BACKGROUND OF THE INVENTION

1. Field of the Invention

The present invention relates to a microstrip antenna. Specifically, it relates to a miniaturized microstrip antenna with variable broadband operation.

2. Description of the Related Art

The size of a conventional microstrip antenna is determined by half of the operating wavelength. However, when the conventional microstrip antenna is operates at VHF or UHF band, the size of a conventional microstrip antenna is increased to enhance reception. Consequently, the size of a conventional microstrip antenna can become unduly large when operating at a low resonant frequency.

Examples of existing, conventional microstrip antennea are disclosed as follows: TAIWAN patent no.364228 "Miniaturized broadband microstrip antenna", U.S. Pat. No. 5,453,752 "Compact broadband microstrip antenna" and U.S. Pat. No. 5,680,144 "Wideband, stacked doubled C-patch antenna having gap-coupled parasitic elements"; or Euro patent no. EP0624578 "Compact broadband microstrip antenna", etc.

In the prior art, a single probe-fed microstrip antenna is proposed and the dual frequency operation is achieved by embedding slots to the microstrip patch. Moreover, since that the frequency ratio of the two operating frequencies is not necessary to be very close, the dual-band design is more simple than the proposed broadband design. By using slots to change the surface current distribution of the resonant modes, dual-frequency operation with a variable ratio of the two frequencies can be obtained. However, to obtain a broadband performance, the two resonant frequencies must be relatively close to one another and the frequency ratio of the two resonant frequencies must meet certain limits.

Furthermore, the current trend of integrated circuit design is for virtually all communication products to become miniaturized in size. Apart from the broadband operation incorporated into the system, the design of the antenna needs to allow for the miniaturization of antenna size according to the overall circuit size.

However, in the conventional art disclosed above, there is currently no such design utilizing slots to both increase the operating bandwidth of the antenna while simultaneously minimizing the antenna size.

SUMMARY OF THE INVENTION

The object of the invention is to provide a simple, miniaturized variable bandwidth broadband microstrip antenna with variable broadband operation.

To achieve the objective described above, the present invention provides a microstrip antenna comprised of a ground patch and an isosceles-triangular patch with a pair of primary slots extending from the top angle towards the base angles with a second pair of slots (hereinafter referred to as the second and third slots) connected to and extending downward from each of the primary slots. The primary slots are approximately parallel to the sides of the isosceles-triangular patch while the second and third slots are approximately perpendicular to the base side of the triangle. A substrate connects the ground patch and the isosceles-triangular patch.

The proposed microstrip antenna has a simple structure, low prime cost, is easy to manufacture and achieves size reduction at wide operating bandwidth. The microstrip antenna of the present invention thus has good application value for the manufacturing industry.

BRIEF DESCRIPTION OF THE DRAWINGS

The invention is hereinafter described in detail by reference to the accompanying drawings in which.

DETAILED DESCRIPTION OF THE INVENTION

The present invention is a reduced-size antenna with variable broadband operation. In the following description of the embodiment, a probe-fed method is adopted as the example. However, it shall be understood this method is for illustrative purposes only. Therefore, this demonstrated methodology should not limit the scope of the present invention. Any other feed methods may also be adopted under the same application. Additionally, only the essential components of the present invention are introduced herein. Other components generally known to those skilled with the art have been omitted to keep the description concise. As for the values of the sizes designated to the embodiment of the present invention described below, the values are for illustrative purpose only. The practical values should depend upon the actual application or practice. It should also be noted that the shapes of the slots and the microstrip patch, their respective sizes and configurations assigned are specific, demonstrative examples only. They also shall not limit the scope of the present invention.

Figure 1:
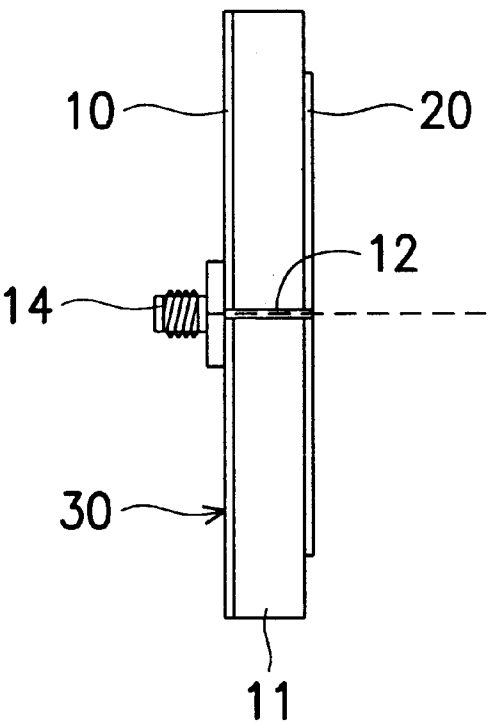
FIG. 1 is a side view of the structure of the microstrip antenna of the present invention.

As shown in FIG. 1 and FIG. 2, the microstrip antenna of the present invention is primarily composed of a substrate and two patches. In the embodiment of the present invention, microstrip antenna 30 contains a ground patch 10 and a microstrip patch 20. In addition, a substrate 11 is located between the two patches. Also, a first terminal such as connector 14 penetrating through the substrate 11 and the ground patch 10 has a second terminal such as a positive terminal 12 connected to a feed point 26 of the microstrip patch 20. Furthermore, the ground patch 10 is electrically linked to the ground.

Since substrate 11 is made from insulating materials, the resonant frequency and the operating bandwidth of the antenna are varied under the influences of the dielectric constant. The shape of microstrip patch 20 is an equilateral triangle with a pair of bent slots embedded in the equilateral-triangular patch 20. In the embodiment of the present invention, the microstrip patch 20 has been designed as an equilateral triangle comprised of three sides, 21,22 and 23. Sides 22 and 23 represent respectively the first and second sides, while side 21 represents the third or base side of the triangle. Each side of the triangle 20 is about 5 cm in length. The triangle also has a pair of slots, 24 and 25, symmetrical to the Y-axis. Slots 24 and 25 comprise three sections of slots of different lengths: slot 24 is comprised of slots 24A, 24B and 24C, while slot 25 is comprised of slots 25A, 25B and 25C.

Figure 2A:
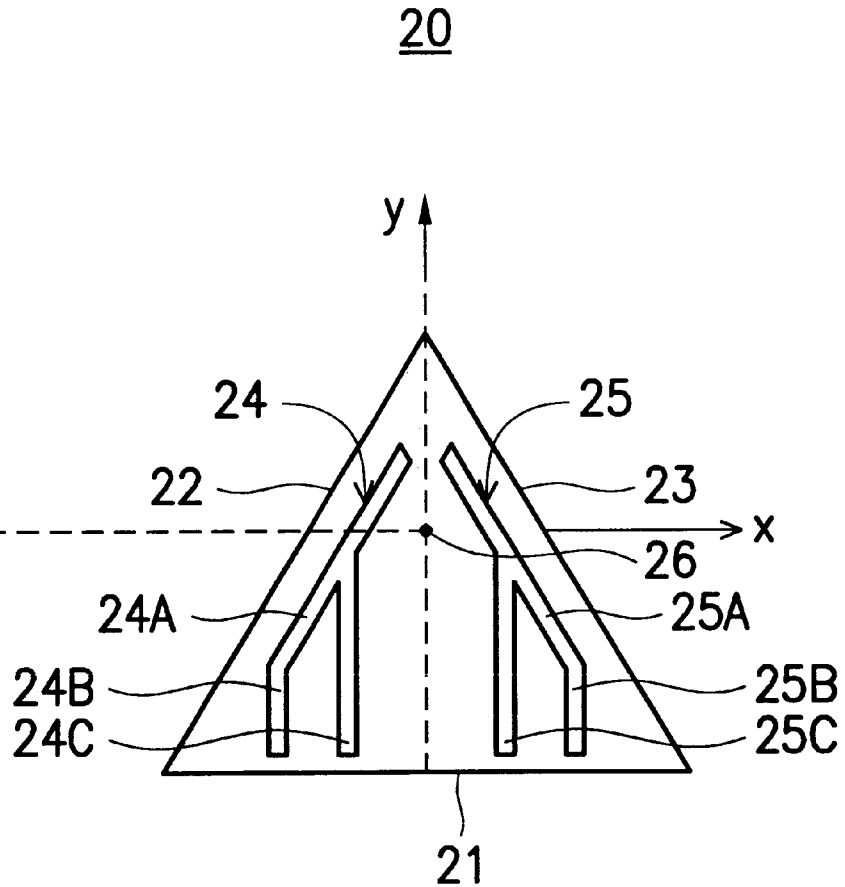
FIG. 2A is a top view of the structure of the microstrip antenna of the present invention.

Slots 24A and 25A are parallel to sides 22 and 23 respectively of equilateral triangle 20. Slots 24A and 25A are offset from their respective sides of equilateral triangle 20 approximately 0.3 to 0.5 cm thereby providing improved broadband performance. Slots 24B and 25B are connected to slots 24A and 25A near the base side 21 of the equilateral-triangular patch 20 at an angle of 150 degrees to slots 24A and 25A respectively and are parallel to the Y-axis. The two slots 24B and 25B are approximately 0.04 to 0.06 cm away from the base side 21 of the equilateral-triangular 20. Furthermore, slots 24C and 25C are located between the center line (Y-axis) of the equilateral-triangular patch 20 and slots 24B and 25B respectively. The two slots 24C and 25C are parallel to slots 24B and 25B respectively. The feed point 26 of the connecting terminal 12 is located at approximately the center line (Y-axis) of the isosceles-triangular patch 20, as shown in FIG. 2A. In the present design, by selecting a proper dimension of such a pair of slots, the first two broadband radiation modes of $TM_{10}$ and $TM_{20}$ of the microstrip antenna can be perturbed such that these two modes of similar radiation characteristics can be exited at frequencies close to each other. Consequently, the microstrip antenna bandwidth can be enhanced as well as antenna size is greatly reduced.

Figure 2C:
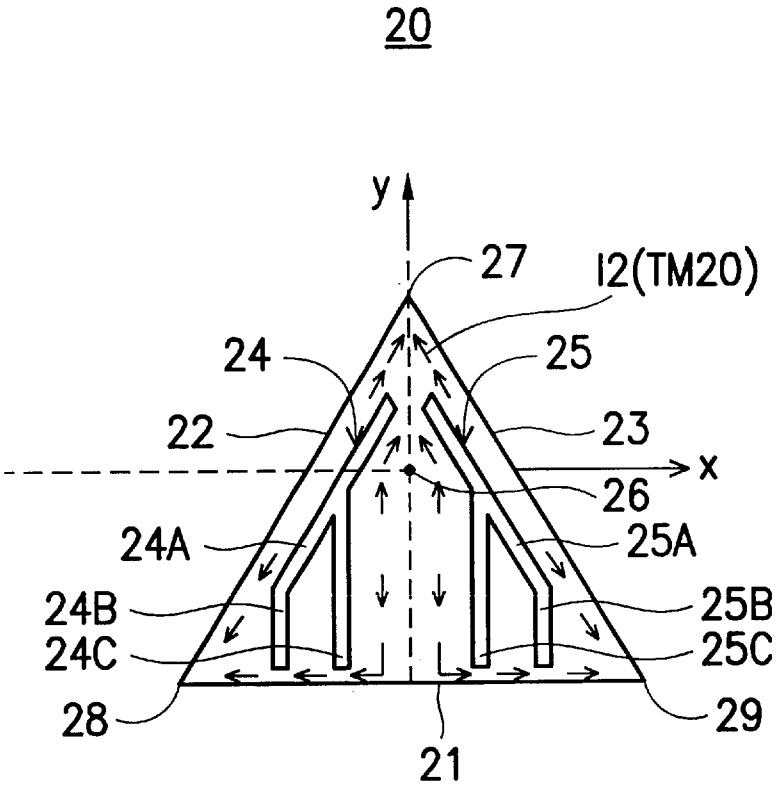
FIGS. 2B and 2C show the patch surface current distributions of the two resonant modes for the present invention in FIG. 1.
Figure 2B:
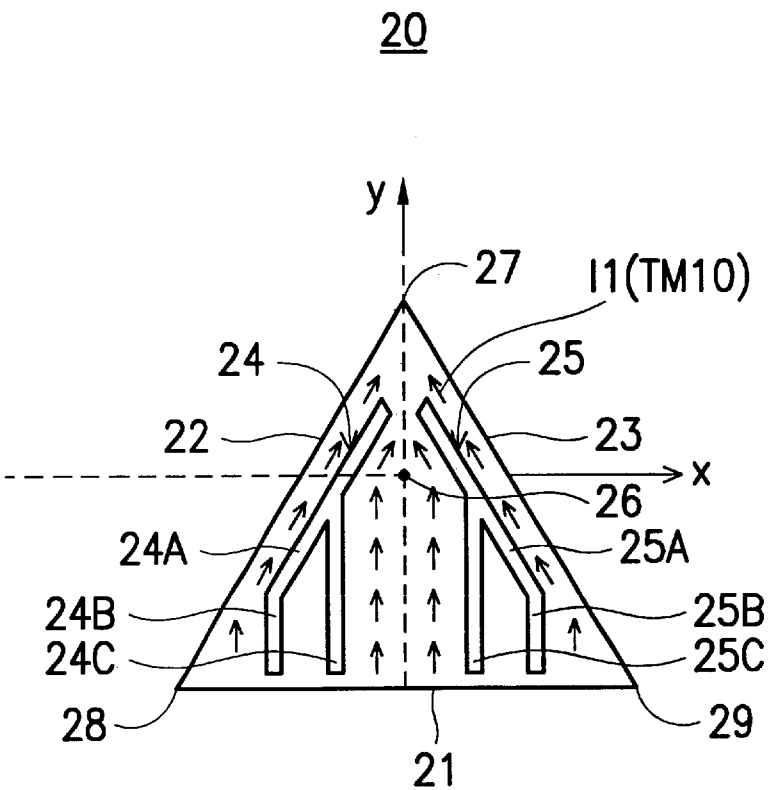

As shown in FIG. 2B and 2C, the two excited resonant modes demonstrate a first resonant mode ($TM_{10}$) and a second resonant mode ($TM_{20}$) of the equilateral-triangular microstrip antenna. Wherein, the corresponding excited patch surface current of the first resonant mode ($TM_{10}$)is 1 and the corresponding excited patch surface current of the second resonant mode ($TM_{20}$) is 2. The corresponding exited patch surface current 1 flows along the Y dimension toward the top angle 27 whereas the corresponding excited patch surface current 2 flows from the center of the triangular patch toward the top angle 27 and the base angles 28 and 29. In the microstrip antenna of the present invention, slots 24B, 24C, 25B and 25C are parallel to the Y-axis. Therefore, they do not perturb the excited patch surface current 1 of the $TM_{10}$ mode, and the resonant frequency of the $TM_{10}$ mode will not be affected by the slots described above. On the other hand, the exited patch surface current path of the $TM_{20}$ mode well be increased by the slots described above. The resonant frequency of the $TM_{20}$ mode is lowered significantly by increasing the dimension of the slots 24B, 24C, 25B and 25C.

In addition, since slots 24A and 25A are not parallel to the excited patch surface current of the $TM_{10}$ mode, the resonant frequency of the $TM_{10}$ mode can be changed by adjusting the lengths of the slots described. In the embodiment of the present invention, slots 24A and 25A are extended toward the center of the isosceles-triangular microstrip patch 20 along the dimension parallel to the equilateral sides 22 and 23 of the equilateral triangle causing the resonant frequency of the $TM_{10}$ mode to decrease progressively. Consequently, by decreasing the resonant frequencies of the $TM_{10}$ and $TM_{20}$ mode, the microstrip antenna of the present invention can achieve broadband operation while effectively minimizing the size of the antenna.

The relevant testing result of the embodiment of the present invention is presented in FIGS. 3 thru 6. The improvement made by the present invention can thus be proved by the numerical experiment results described below.

The First Embodiment

Figure 3:
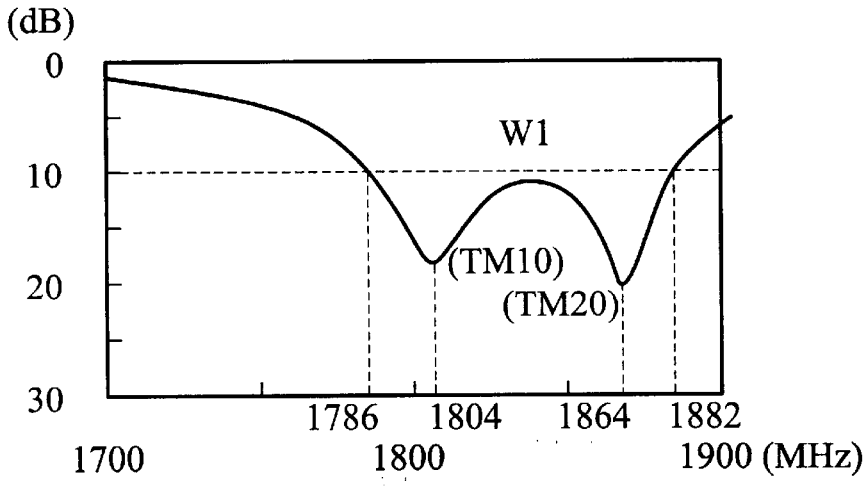
FIG. 3 shows the measured result of the input resistive experiment according to the size of the slots of the microstrip antenna of the present invention.

FIG. 3 represents the measured result of the return loss of the microstrip antenna apparatus of the present invention. To achieve the objectives of miniaturization and bandwidth enhancement of the microstrip antenna of the present invention, the lengths of the slots 24A, 24B and 24C are adjusted to 23 mm, 7 mm and 15.5 mm respectively, and the distance between slots 24B and 24C is adjusted to 4 mm. Slot 25 is symmetrical to slot 24 and is configured with the same principle. After measuring, it was found that the impedance bandwidth W1, determined from 10 dB return loss, of microstrip antenna apparatus configured can achieve 5.0% (96 MHz) which is approximately 3 times more bandwidth than a conventional microstrip antenna.

The Second Embodiment

Figure 4:
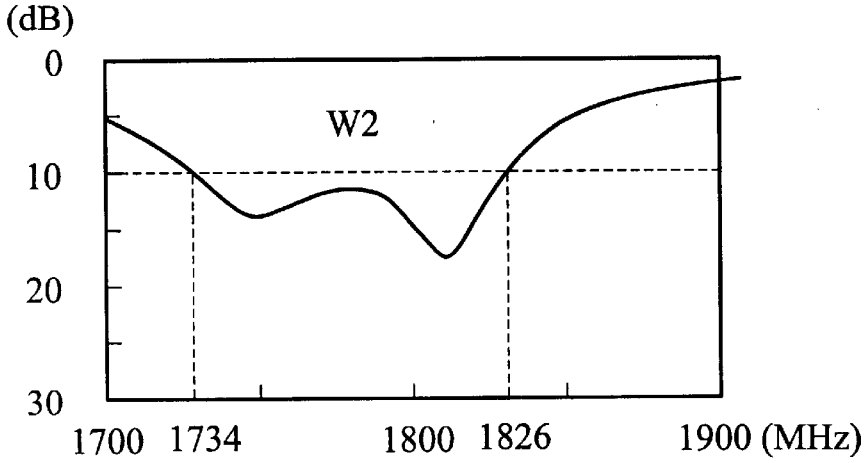
FIG. 4 shows the measured result of the return loss according to the size of the slots (modified) of the microstrip antenna of the present invention.

FIG. 4 represents the measuring result of the return loss relative to the slot size(s) of the microstrip antenna apparatus of the present invention. In the second embodiment, the slot lengths of the first embodiment are extended. The lengths of slots 24A, 24B and 24C are adjusted to 26 mm, 7 mm and 18 mm respectively, and the distance between slots 24B and 24C is adjusted to 5 mm. Slot 25 is symmetrical to slot 24 and is configured with the same principle described above. After measuring, it is found that the impedance bandwidth W2, determined from 10 dB return loss, of the microstrip antenna can achieve 5.2% (92 MHz) which is approximately 3.25 times that of a conventional microstrip antenna.

The Third Embodiment

Figure 5:
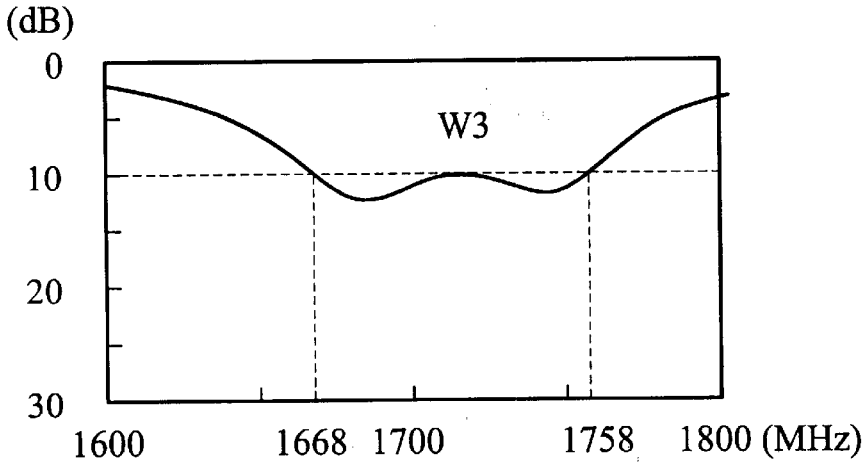
FIG. 5 shows the measured result of the return loss according to the size of the slots (again, modified) of the microstrip antenna of the present invention.

FIG. 5 represents the measured result relative to the slot sizes of the microstrip antenna apparatus of the present invention. In the third embodiment, the slot lengths of the second embodiment are again extended. The lengths of slots 24A, 24B and 24C are adjusted to 27 mm, 7.2 mm and 18.5 mm respectively, and the distance between slots 24B and 24C is adjusted to 6 mm. Slot 25 is symmetrical to slot 24 and is configured with the same principle described earlier. After measuring, it is found that the impedance bandwidth, determined from 10 dB return loss, of the microstrip antenna can achieves 5.3% (90 MHz) which is approximately 3.5 times that of a conventional microstrip antenna.

From the experimental results described above, it is demonstrated that the bandwidths (determined from 10 dB return loss) of the three embodiments respectively are: 1786 MHz~1882 MHz for the first embodiment, 1734 MHz~1827 MHz for the second embodiment and 1668 MHz~1758 MHz for the third embodiment. It is noted that the bandwidths decrease sequentially. Compared with a conventional isosceles and/or equilateral-triangular microstrip antenna, the area reduction rates achieved are approximately 8.2%, 14.9% and 24.9% respectively. In other words, when the design parameters described are used in the third embodiment, the size of the equilateral-triangular patch with operating bandwidth of 5.3% can be reduced to about 75% of a conventional equilateral-triangular microstrip antenna. The contrast is even greater when compared with a conventional circular microstrip antenna whereby size can be reduced to about 60% that of the conventional circular microstrip antenna.

Figure 6B:
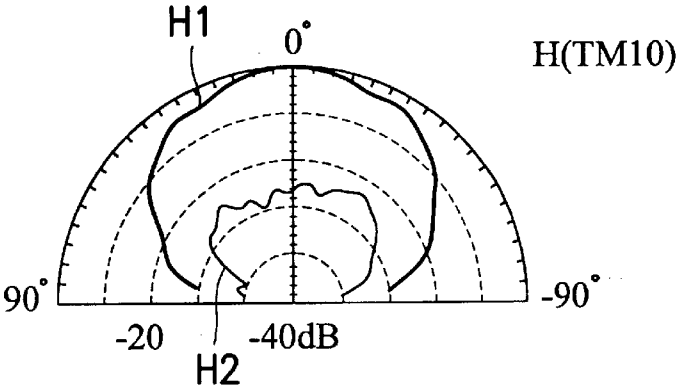
FIGS. 6A and 6B represent the measured results of the E-plane and the H-plane radiation patterns of the microstrip antenna at the first resonant mode.
Figure 6D:
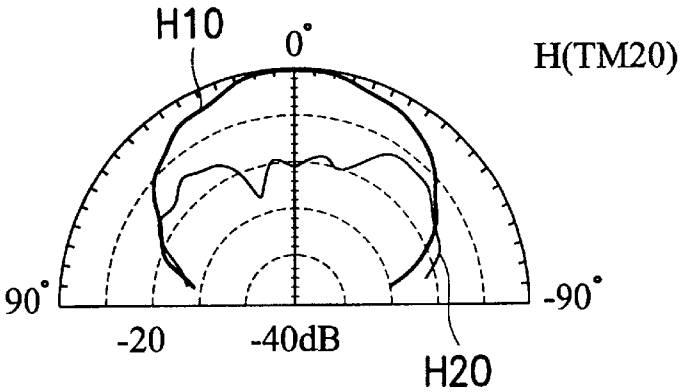
FIGS. 6C and 6D represent the measured results of the E-plane and H-plane radiation patterns of the microstrip antenna at the second resonant mode.
Figure 6A:
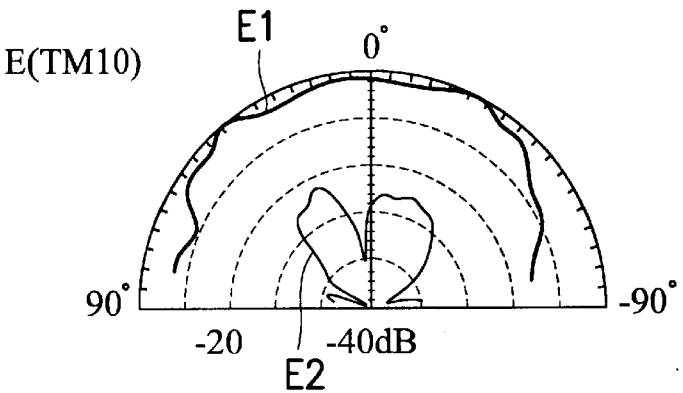
Figure 6C:
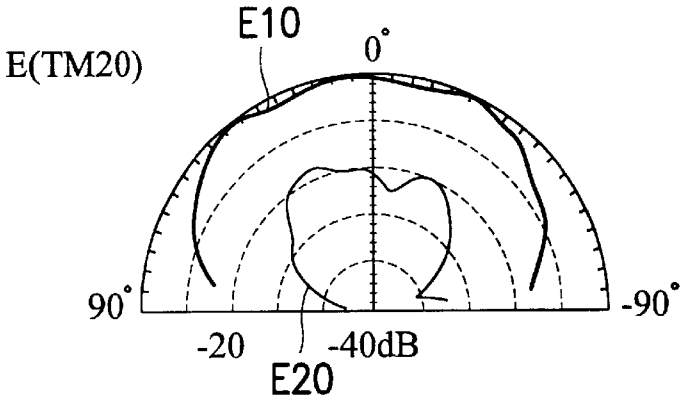

Please refer to FIGS. 6A, 6B, 6C and 6D, wherein, FIGS. 6A and 6B are the measured E-plane and the H-plane radiation patterns of the microstrip antenna at the first resonant mode $MT_{10}$ shown in FIG. 3. FIGS. 6C and 6D represent the measured results of the E-plane and H-plane radiation patterns of the microstrip antenna at the second resonant mode $TM_{20}$ shown in FIG. 3.

As demonstrated by FIGS. 3, 6A and 6B, the resonant frequency of the first resonant mode is 1804 MHz. The bold lines E1 and H1 represent the measured results of the copolarized radiation patterns in the E-plane and the H-plane respectively, while the lines E2 and H2 represent the measured results of the crosspolarized radiation patterns in the E-plane and the H-plane respectively. FIGS. 3, 6C and 6D demonstrate the resonant frequency of the second resonant mode $TM_{20}$ is 1882 MHz. The bold lines represent the measured results of the copolarized radiation patterns in the E-plane and the H-plane respectively whereas the lines E20 and H20 represent the measured results of the crosspolarized radiation patterns in the E-plane and the H-plane respectively.

It can be concluded from the comparisons between FIGS. 6A, 6B, 6C and 6D that the resonant mode $TM_{10}$ and the resonant mode $TM_{20}$ have similar radiation characteristics and same polarization planes. Additionally, by comparing the measured results of the crosspolarized radiation patterns of both the E-plane and the H-plane for the two resonant modes, the radiation intensities are similar. The crosspolarization levels for the two resonant modes are larger than 15 dB.

Therefore, from the experimental results of the embodiment herein described, the structure of the microstrip antenna of the present invention does achieve the objective of broadband operation while also achieving size reduction. The present invention can be applied to a variety of a personal mobile communication devices such as Digital Enhanced Cordless Telephones (DECT) 1800, Personal Communication Systems (PCS) 1900, or the 2.45 GHZ wireless communication modules of home RF applications.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements, which is defined by the following claims and their equivalents.

What is claimed is:

1. A microstrip antenna, comprising:

a first patch;

a second patch with a triangular shape having a base and a first and a second sides, the first and second sides being equal in length, wherein the second patch is provided with a first primary slot disposed along the first side, a second primary slot disposed along the second side, a first secondary slot connected to the first primary slot and extending towards the base, and a second secondary slot connected to the second primary slot and extending towards the base; and a substrate, located between the first patch and the second patch.

2. The microstrip antenna as claimed in claim 1, further comprising a first tertiary slot connected to base end of the first primary slot and extending towards the base, and a second tertiary slot connected to the base end of the second primary slot and extending towards the base.

3. The microstrip antenna as claimed in claim 1, wherein the first and second primary slots are substantially symmetrical and substantially parallel to the first and second sides of the second patch, respectively.

4. The microstrip antenna as claimed in claim 1, wherein the secondary slots are substantially symmetrical and substantially perpendicular to the base.

5. The microstrip antenna as claimed in claim 2, wherein the tertiary slots are substantially symmetrical and substantially perpendicular to the base.

6. The microstrip antenna as claimed in claim 1, wherein the first patch is connected to a ground.

7. The microstrip antenna as claimed in claim 1, further comprising a connecting apparatus having a first and a second terminal, wherein the first terminal is coupled to a ground and the second terminal is coupled to the second patch.

8. The microstrip antenna as claimed in claim 7, wherein the first terminal is coupled to the first patch and the second terminal penetrates through both the first patch and the substrate coupled to the second patch.

9. The microstrip antenna as claimed in claim 8, wherein the second terminal is coupled to the second patch at approximately the center line of the second patch.

10. The microstrip antenna as claimed in claim 9, wherein the second terminal is coupled to the second patch at approximately the center point of the central line of the second patch.

11. The microstrip antenna as claimed in claim 10, wherein the second patch is equilateral-triangular.

* * * * *

UNITED STATES PATENT AND TRADEMARK OFFICE

CERTIFICATE OF CORRECTION

PATENT NO. : 6,400,322 B2 
DATED : June 4, 2002
INVENTOR(S) : Shyh-Tirng Fang and Kin-Lu Wong It is certified that error appears in the above-identified patent and that said Letters Patent is hereby corrected as shown below:

Title page,
Add Item titled:

-- [30] Foreign Application Priority Data
Apr. 7, 2000 (TW) Taiwan ..... 89106375 --.

Signed and Sealed this

Fourth Day of March, 2003

JAMES E. ROGAN
*Director of the United States Patent and Trademark Office*